United States Patent [19]

Gallagher

[11] 4,008,575

[45] Feb. 22, 1977

[54] LIGHTWEIGHT END CONNECTORS FOR POLLUTION CONTAINMENT BOOM

[76] Inventor: John J. Gallagher, 171 Williams Drive, Annapolis, Md. 21401

[22] Filed: Apr. 16, 1975

[21] Appl. No.: 568,678

[52] U.S. Cl. ..... 61/1 F; 24/201 C; 52/594; 61/62; 403/326

[51] Int. Cl.[2] ..... E02B 3/00

[58] Field of Search ..... 61/1 F, 62; 24/201 C; 403/326; 16/172, 171; 52/594

[56] References Cited

UNITED STATES PATENTS

| | | | |
|---|---|---|---|
| 2,354,485 | 7/1944 | Slaughter | 24/201 C X |
| 2,810,944 | 10/1957 | Sander | 24/201 C |
| 3,380,481 | 4/1968 | Kraus | 24/201 C X |
| 3,756,031 | 9/1973 | Smith et al. | 61/1 F |
| 3,886,633 | 6/1975 | Ausnit | 24/201 C |
| 3,918,131 | 11/1975 | Ausnit | 24/201 C |

FOREIGN PATENTS OR APPLICATIONS

| | | | |
|---|---|---|---|
| 777,454 | 2/1968 | Canada | 24/201 C |
| 477,940 | 2/1953 | Italy | 24/201 C |

*Primary Examiner*—Ramon S. Britts

[57] ABSTRACT

A connector for elements of floating pollution containment booms having a sliding tongue-in-groove joint with members formed to direct transverse forces, generated by tension in the joint, inwardly of the joint to affect stronger interconnection between the elements.

3 Claims, 3 Drawing Figures

LIGHTWEIGHT END CONNECTORS FOR POLLUTION CONTAINMENT BOOM

BACKGROUND

This invention relates generally to floating pollution barriers and more particularly to an improved connector for interconnecting elements at such barriers or "booms".

In connecting oil boom elements, there is a requirement that the means for carrying out the connection be fluid tight, quick, simple and durable so that the boom elements may be readily interconnected under adverse conditions. There is also an essential requirement that the means be resistant to damage from the diverse forces, dangers and misuses encountered in the marine environment. A popular type of device for accomplising interconnection of boom elements has been the slide type of tongue-in-groove connection wherein a grooved member on the end of one boom element accepts a mating tongue on another element through edgewise sliding assembly. The term "element" as used herein should be understood to include like sections of boom or terminal fittings such as towing units, mooring assemblies or bulkhead and hull connections. The above described arrangement has proven very effective from the standpoint of simplicity and quickness of assembly. Since the prior art structures have been sensitive to configuration, however, they have required the use of heavy and bulky section thicknesses to provide configuration retention and durability in the marine environment.

SUMMARY OF THE INVENTION

This invention provides an improved tongue-in-groove type of boom element connector which enables the utilization of relatively thin, lightweight sections in the makeup thereof.

The invention also provides for the formation of a durable boom element connector out of a flexible or deflectible material which is resistant to permanent deformation under abusive or accidental overloading or misapplication of loads during use.

The invention achieves the above ends by providing a connector having a tongue-in-groove joint formed such that the resulant transverse force components generated in the joint by tension load between the elements are directed inwardly toward one another thereby reducing the requirement for the joint to resist large transverse moments in bending as a result of the transverse forces being otherwise directed.

In a preferred embodiment, the invention provides a connector for elements of a floating pollution containment boom including complimentary slides on each of the elements, the slides having a pair of flanges parallelplanar with the plane of the element to form a groove therebetween, transverse members on the free ends of the flanges with rearward faces thereon forming an acute angle with the plane of the element to partially close the groove defined by the flanges, the flange and transverse member forming a tongue complimentary to the groove on a corresponding connector such that, when assembled in the groove of a corresponding connector, resultant transverse forces imposed on the flanges forming the groove are directed inwardly by the reaction of the abutting rearward faces to tensile loads on the connector.

These and other objects and advantages of the invention will become better understood to those skilled in the art by reference to the following detailed description when viewed in light of the accompanying drawing wherein:

DESCRIPTION OF A PREFERRED EMBODIMENT

Figure 1:
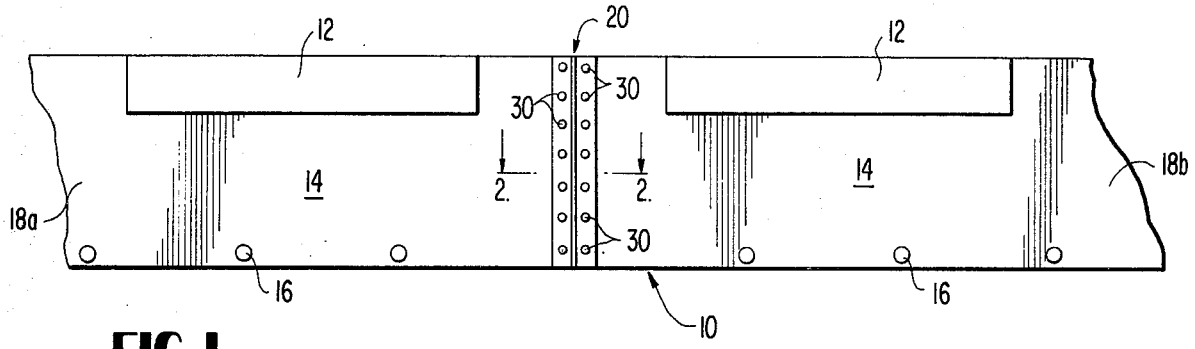
FIG. 1 is an elevational view of a segment of a floating pollution boom including a barrier section joint in accordance with the invention.

In FIG. 1, a portion of a floating pollution containment barrier or boom is shown generally at 10. The boom, of any of the types known in the art generally consists of floatation 12 such as expanded polyethylene foam, a flexible skirt 14 depending beneath the floatation 12 and ballast 16 of a material more dense than water. In the embodiment illustrated, the connection is made between two boom sections **18*a* and 18*b* by a connector indicated generally at 20. As was stated above, the connector 20** can also be applied to interconnection of boom elements other than boom sections.

Figure 2:
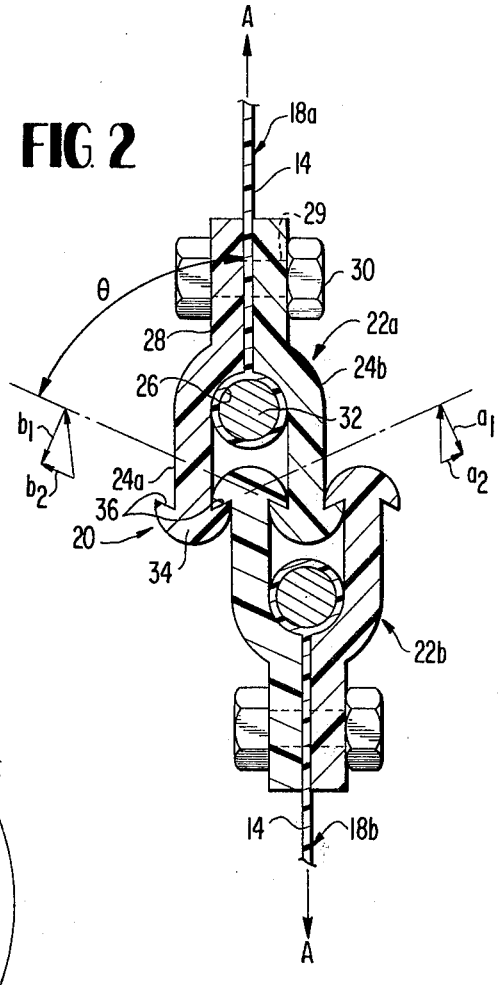
FIG. 2 is an enlarged sectional view of the joint of FIG. 1 taken along the line 2—2 thereof.

In FIG. 2, the connector 20 consists of two complimentary slides **22*a* and 22*b* mounted on the ends of sections 18*a* and 18*b* respectively. In the embodiment shown, the slides are identical and the specific description set forth hereinafter as directed to slide 22*a* should also be understood to apply to slide 22*b*.** The identical arrangement of slides lends universality to the end connectors in that any end of a boom section may be connected to any other end of another boom section without regard to the configuration of the slide as long as the section is equipped with slides in accordance with this description. Where universality is not required, the slides can be of differing complimentary configuration as will be described in greater detail below.

The slide **22*a* comprises vertical flanges 24*a* and 24*b* extending in parallelplanar relationship to the plane of the section 18*a*. In this embodiment, each flange is identical in mirror image and what is specifically described hereinater for flange 24*a* should be understood to be equally applicable to flange 24*b*. Where universality of interconnection is not required, as was indicated above, slide 22*b* could consist of a single flange 24*a* while slide 22*a*** comprised a pair of flanges or visa versa.

Flange **24*a* terminates, at one edge thereof, in a curved chanel 26 which, in turn, terminates in a flat longitudinal plate 28. The plate is provided with vertically spaced holes 29 for receiving connecting bolts and nuts 30 to provide connection of the slide 22*a* to the end of the boom section 18*a* as is shown. Where a single flange is used, as was described above, a plate drilled with corresponding vertically spaced holes (not shown) can be used in place of the companion flange 24*b* to achieve connection to the end of the boom section. In other embodiments, the flanges 24*a* and 24*b* can be formed as an integral unit in which case connection to the boom section can be accomplished in other ways such, for example, as by bolts through holes drilled in a common plate and drilled backup plate or the like. The boom section 18***a* is furnished with a vertical welt 32 encased in the skirt material 14. The welt is engaged by the companion channels of the flanges 24*a* and 24*b* to distribute loading from the connector over the entire width of the skirt 14.

The free end of the flange 24*a* is provided with a transverse member 34 extending from each side thereof. The transverse member has rearward faces 36 formed on each side thereof, each of the faces 36 extending at an angle $\theta$ of less tha 90° to the plane of the boom section 18*a* as shown.

As is seen in FIG. 2, the above-described structure, when used in conjunction with identically formed structure slide 22*b*, forms a tongue-in-groove joint which is made or unmade by moving the slides vertically relative to one another. Tension imposed on the connector 20, as indicated by arrows A, will be resisted in flange 24*a* by a force system comprising a component normal to the rearward face 36 ($a_1$) and a transverse component ($a_2$). At the same time, the force A will react in flange 24*b* with a system consisting of normal component $b_1$ and transverse component $b_2$. As can be seen, the transverse components $a_2$ and $b_2$ are equal and inwardly opposed thereby removing the requirement for resistane to imbalanced ending loads in the flanges 24*a* and 24*b*. The corresponding flanges of slide 22*b* are identically loaded with the same resultant force system and absence of bending loads due to tension between the sections 18*a* and 18*b*.

Figure 3:
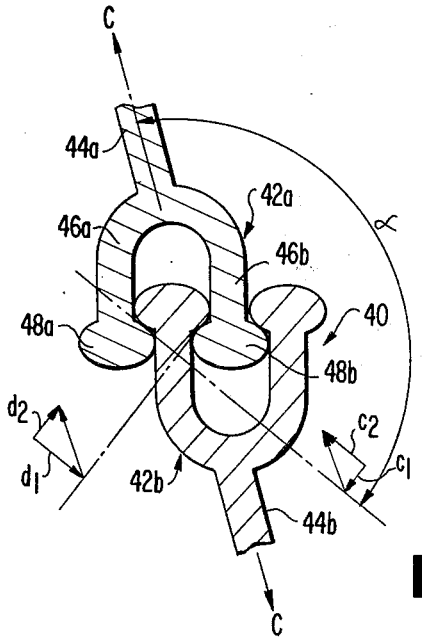
FIG. 3 is a view similar to FIG. 2 of a prior art barrier joint.

FIG. 3 depicts the prior art as exemplified by a connector 40 having identical forked slides 42*a* and 42*b* connected to boom elements 44*a* and 44*b*. Slide 42*a* consists of left and right vertical flanges 46*a* and 46*b* terminating in bulbous rails 48*a* and 48*b*. As is seen, the contacting surfaces of the rails 48*a* and 48*b* (50) form an angle $\alpha$ of greater than 90° with respect to the plane of the section 44*a*. Tensile force imposed on the slides 42*a* and 42*b* when connected as represented by arrows C, are resisted in the connection 40 by a force system in flange 46 a consisting of a normal force component $c_1$ and a transverse component $c_2$ while that in 46*b* is composed of normal force $d_1$ and transverse force $d_2$. It is seen than the reaction forces are outwardly directed because of the angle of the bearing surfaces and bending loads are therefore imposed on the flanges 46*a* and 46*b*. These loads must be resisted by strengthening the flange structure to withstand the bending load thereby imposing greater bulk and weight in the resulting connector. The need for bending resistance also eliminates the use of a flexible material in the connector with the attendant advantages set forth above.

The connector 20 of the present invention may be fabricated of any material of suitable tensile strength, durability and compatibility with the marine environment in which the connector is to be used. For example, the materials can be metal such as stainless steel or aluminum or can preferably consist of suitable plastics such as polyurethane or polyethylene extrusions or moldings.

The joint, once made, can be secured by any of the methods known in the art so long as sliding movement between the slides 22*a* and 22*b* is blocked while connection is desired. A preferred method, for example, would be would be a pin marketed under the trademark BALL-LOK by Avibank Mfg., Inc. of Burbank CA inserted through aligned, transverse bores (not shown) through each of the slides 22*a* and 22*b*.

What has been set forth above is intended to be exemplary of a teaching in accordance with the invention to enable those skilled in the art to engage in the practice thereof.

What is new and desired to be protected by Letters Patent of the United States is:

1. A fluid-tight connector for elements of floating pollution containment booms comprising disconnectible elements including at least one floating pollution containment boom, at least one of the elements being secured along substantially the entire extent of a vertical edge of said pollution containment boom, complimentary slides on the ends of each of the elements, at least one of said slides including:

a pair of flanges parallelplanar with the plane of and extending from the end of said element to form a groove therebetween; and transverse members on the free ends of said flanges, said transverse members having rearward faces on each side thereof disposed to form an angle of less than 90° with the plane of said element and to partially close the opening in the groove formed by said flanges, said flanges being of a thicknss substantially equal to the width of said opening, said transverse members and flanges forming tongues which, when inserted into the groove of a corresponding slide, are configured to form a fluid-tight connection between elements, and said transverse members and flanges including means to direct resultant transverse forces imposed on the flanges forming the groove inwardly through reaction on the abutting rearward faces and to block withdrawal of said tongue from said groove in directions other than parallel to said groove.

2. A connector in accordance with claim 1 wherein both of said slides comprise a pair of said flanges.

3. A connector in accordance with claim 2 wherein said slides are fabricated of a flexible material.

* * * * *